United States Patent [19]

Brunet

[11] Patent Number: 4,569,275

[45] Date of Patent: Feb. 11, 1986

[54] PORTABLE PUMP FOR INFLATING TIRES, IN PARTICULAR FOR A BICYCLE

[75] Inventor: Patrice Brunet, Neuilly-sur-Seine, France

[73] Assignee: Poutrait-Morin, Aubervilliers, France

[21] Appl. No.: 674,091

[22] Filed: Nov. 23, 1984

[30] Foreign Application Priority Data

Nov. 23, 1983 [FR] France ..... 83 18634

[51] Int. Cl.[4] ..... F01B 31/00; F04B 39/00

[52] U.S. Cl. ..... 92/58.1; 417/555 R; 417/572

[58] Field of Search ..... 417/63, 234, 313, 469, 417/550, 555 R, 572, 557; 92/58.1; 222/384, 402; 280/289 R

[56] References Cited

U.S. PATENT DOCUMENTS

| | | | |
|---|---|---|---|
| 1,553,938 | 9/1925 | Floyd | 92/58.1 |
| 2,334,057 | 11/1943 | Ashton et al. | 92/58.1 |
| 3,907,461 | 9/1975 | Bouder | 417/63 |
| 3,981,625 | 9/1976 | Wickenberg | 417/63 |
| 4,120,614 | 10/1978 | Bouder | 417/63 |

FOREIGN PATENT DOCUMENTS

| | | | |
|---|---|---|---|
| 504922 | 8/1951 | Belgium | 417/550 |
| 638541 | 2/1928 | France | 417/557 |
| 883267 | 3/1943 | France | 417/550 |
| 1161823 | 3/1958 | France | 417/313 |
| 2271417 | 12/1975 | France | 417/63 |
| 2307986 | 11/1976 | France | 417/234 |
| 500262 | 11/1954 | Italy | 417/234 |
| 655951 | 8/1951 | United Kingdom | 417/557 |
| 682485 | 11/1952 | United Kingdom | 417/550 |
| 1232894 | 5/1971 | United Kingdom | 417/555 R |
| 2047352 | 11/1980 | United Kingdom | 417/555 R |

*Primary Examiner*—William L. Freeh
*Assistant Examiner*—Paul F. Neils
*Attorney, Agent, or Firm*—Charles E. Brown; Charles A. Brown

[57] ABSTRACT

A portable pump for inflating tires, particularly bicycle tires. The portable pump comprises a pump body in which there is movably disposed a piston mounted to the end of a rod which is operable in a reciprocating motion. The reciprocating motion is effected by movement of a handle attached to the rod and a spring which is interposed between the pump body and the handle. The piston rod, at its terminal portion remote from the piston, has an extension capable of sliding movement within the handle and which also carries at least one locking structure. The locking structure permits either immobilizing the extension within handle with the spring being neutralized, or sliding movement of the extension in the handle against the force of the spring.

21 Claims, 13 Drawing Figures

PORTABLE PUMP FOR INFLATING TIRES, IN PARTICULAR FOR A BICYCLE

Figure 1:
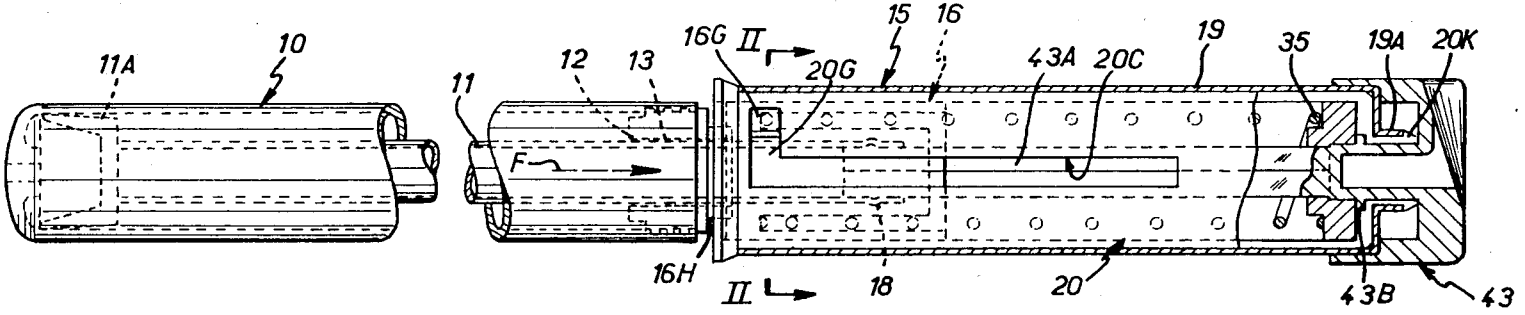

The present invention concerns portable pumps for inflating tires and more particularly pumps which are intended to be removably fixed to the frame of a vehicle, in particular a bicycle.

It is known that pumps of the above-indicated kind comprise, in known manner, a pump body within which a piston can be displaced with a reciprocating motion, the piston being mounted to one end of a rod whose other end is fixed to an operating handle.

As is also known, a compression spring is interposed between a plug or closure member which closes off the end of the pump body which is remote from the discharge end, and the operating handle, the spring being intended in particular to permit the pump to be fixed to the frame of the bicycle, by the spring being compressed.

Such pumps have been and are still satisfactory; however, the presence of the compressing spring referred to above is not without disadvantages.

One of the disadvantages in question is that, in the course of the tire inflating operation, at the end of the air discharge phase, the person using the pump is required to overcome the force of the spring in order to make use of the whole of the volume of the compression chamber which is defined by the internal volume of the pump body. That therefore means that the person using the pump has to produce a substantial force in each operating phase of the pump, and that force increases as the pressure within the tire rises.

In practice, having regard to the foreoging, the whole of the volume which is available in the pump body is used only episodically, so that the pump cannot be used in a rational fashion, which has repercussions on the efficiency thereof.

Another disadvantage which arises because of the above-mentioned spring is that the spring is nonetheless acted upon, to a greater or lesser degree, depending on the thrust force applied to the operating handle, so that the spring is subjected to stresses which have a harmful influence on its characteristics and therefore its service life.

Another disadvantage is that the spring permits only a limited range of movement of the handle, between the unstressed and compressed positions of the spring, so that it is necessary to provide a range of pumps corresponding to the various dimensions of bicycle frames, thus involving keeping stocks of pumps and diversification in manufacture.

The present invention seeks to provide a portable pump for inflating tires, wherein the above-indicated disadvantages are eliminated.

A portable pump according to the invention for inflating tires, in particular for a bicycle, comprising a pump body in which a piston is movable, the piston being mounted to the end of a piston carrier rod which is operable with a reciprocating motion by means of a handle, and a spring interposed between the pump body and the handle, is characterised in that the rod carrying the piston comprises at its terminal portion remote from the piston an extension which is capable of sliding movement within the handle, and which carries at least one locking means which is capable either of immobilizing said extension within the handle, with the spring being neutralized, or permitting sliding movement of the extension in the handle against the force of the spring.

According to a feature of the invention, the extension comprises a sleeve which is fixed with respect to the piston carrying rod and which carries the locking means which comprises at least one lug capable of cooperating with a slot formed in the handle.

In accordance with another feature of the invention, the locking means, in another embodiment, comprises a retractable ring. It will be seen from the foregoing arrangements that axial locking of the handle to the piston carrying rod makes it possible to neutralize the spring while unlocking permits the spring to be compressed.

Various advantages of such arrangements will be noted herein.

One of the advantages of those arrangements is that, in the position of use of the pump, the spring, being in the unstressed condition, is not acted upon in the course of the pumping operations, as it is housed in the handle and the handle is immobilized with respect to the rod. That being the case, the user of the pump is capable of making use of the whole of the available volume in the pump body, hence providing for quicker inflation with a reduced number of pumping actions; at the same time, inflation requires less effort because the spring is neutralized during the inflation operation.

Another advantage is that, as the spring in question is not acted upon during an inflation operation, it is not subjected to repeated stresses, whereby its service life is substantially enhanced.

Yet another advantage is that the length of the spring in the released condition is substantially increased in comparison with the length of the prior-art springs in the released condition; in fact, an increase in the length of the spring is possible for the reason that it is not acted upon in the course of pumping operations, which results in the handle having a travel motion, relative to the pump body, whose amplitude makes it possible to fit the pump to an extended range of frame sizes; that results in a reduction in the number of types of pump, facilitating keeping stocks of pumps and also facilitating manufacture which is thus rationalized.

Figure 7:
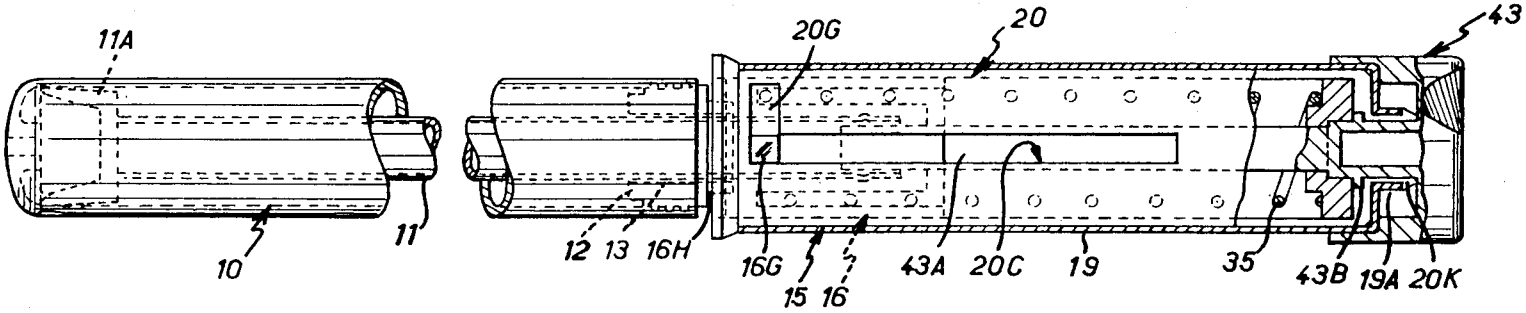
Figure 8:
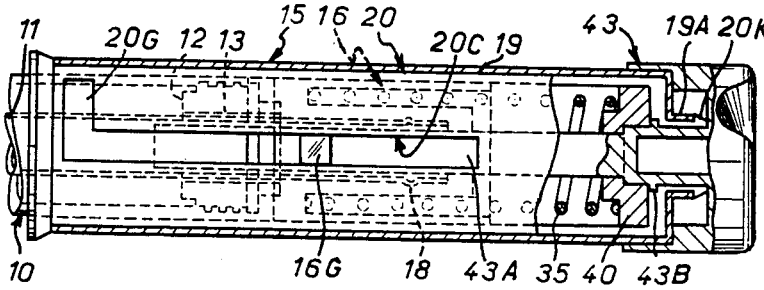
Figure 2:
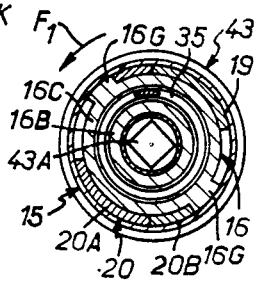
Figure 3:
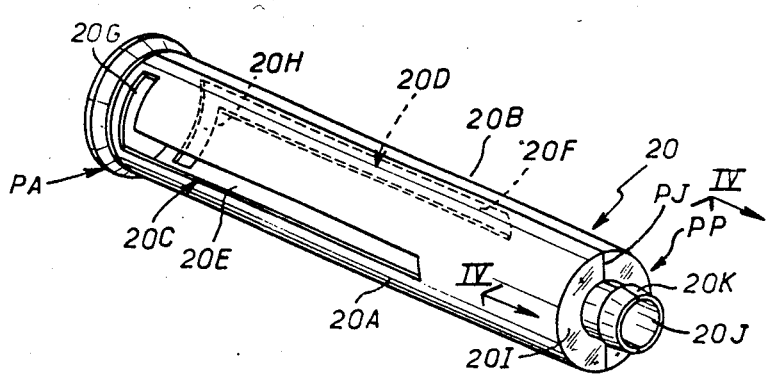
Figure 4:
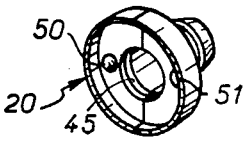
Figure 10:
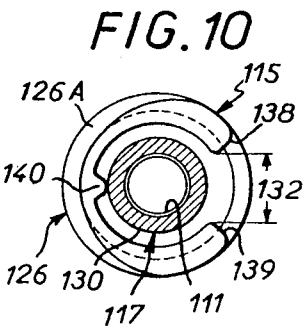
Figure 11:
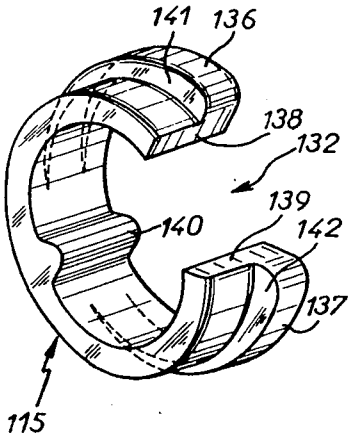
Figure 9:
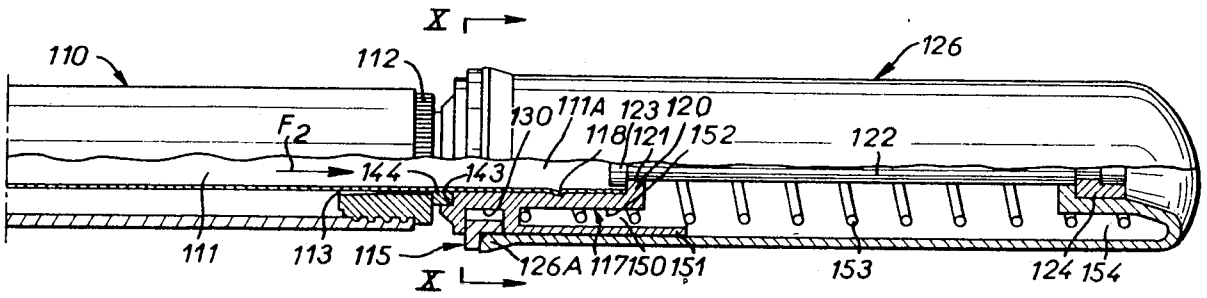
Figure 12:
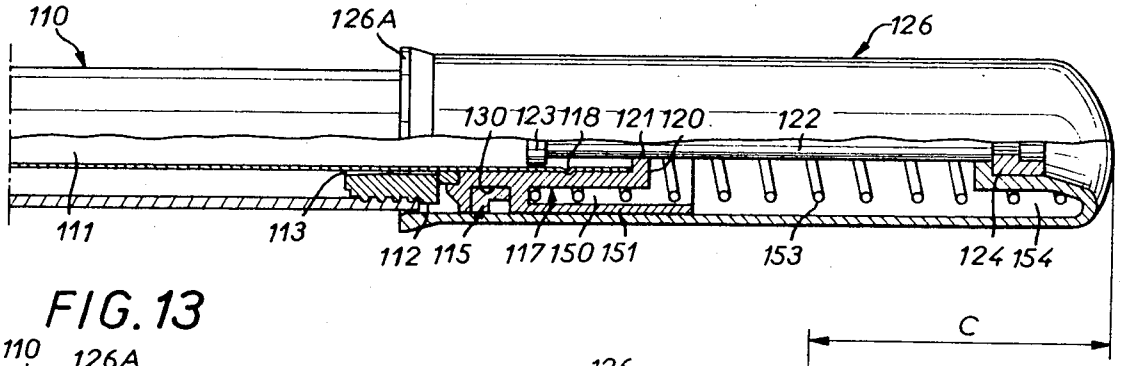
Figure 13:
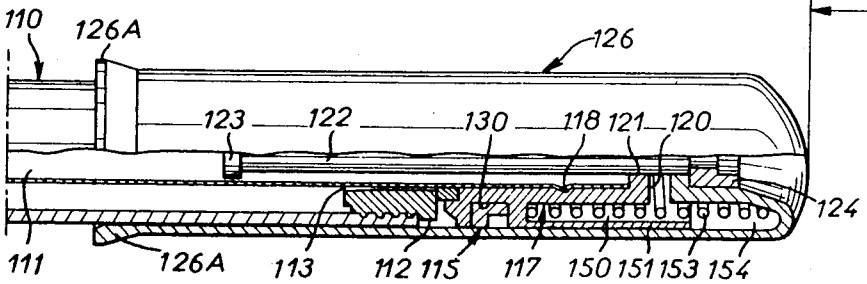

Other features and advantages of the invention will be apparent from the following description which is given by way of example with reference to the accompanying drawings in which:

FIG. 1 shows an embodiment of a pump according to the invention, showing part of the pump at the operating handle end with part in section and part being an outside view, with the pump in the position of use, with the spring neutralized, FIG. 2 is a view in cross-section taken along line II—II in FIG. 1, FIGS. 3 to 6 are perspective views of the various elements forming the handle, FIG. 4 being a perspective view in section taken along line IV—IV in FIG. 3, FIG. 7 is a view similar to that shown in FIG. 1, with the locking means being shown in the released position, FIG. 8 is a similar view to FIG. 7, with the spring no longer being neutralized, thereby permitting the pump to be fixed to a bicycle frame, FIG. 9 is a view of part of another embodiment of a pump according to the invention, showing the handle end, partly in axial section and partly as an outside view, the pump being in the position of use and the spring being neutralized, FIG. 10 is a view in cross-section taken along line X—X in FIG. 9, FIG. 11 is a perspective view of an embodiment of a retractable abutment, FIG. 12 is a view similar to that shown in FIG. 9, with the retractable abutment being in the inoperative position, the handle being capable of sliding movement with respect to the pump body for the purposes of fixing the pump to a bicycle frame, and FIG. 13 is a view similar to those shown in FIGS. 9 and 11, illustrating the spring in the compressed condition.

In a selected embodiment as illustrated in FIGS. 1 to 6, the body of a pump for inflating tires, in particular bicycle tires, of which part is shown, is indicated by reference numeral 10; disposed movably in the pump body 10 is a piston 11A which is of conventional construction and need not be discussed in detail for it is known to one skilled in the art, and which is connected to one end of a rod 11 which is mounted slidably in a plug or closure member 12 which closes off the pump body at the air intake end; in known manner, the closure member 12 comprises a passage 13 for the intake of air into the pump body when the rod 11 and consequently the piston 11A are subjected to a pulling force as indicated by the arrow F.

As shown in FIG. 1, the rod 11 is in the position at the end of the air discharge phase, the piston 11A then being disposed at the other end of the pump body.

In accordance with the present invention, for the purposes of associating the rod 11 with an operating handle indicated generally at 15, the rod 11 comprises a terminal portion forming an extension which projects beyond the pump body.

Figure 6:
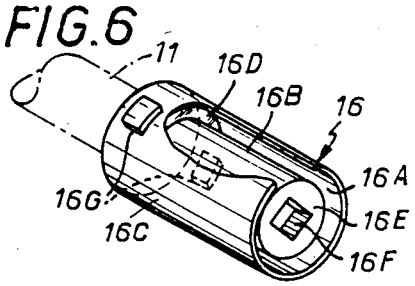

As illustrated, the above-mentioned extension comprises a sleeve or tubular member 16 (see also FIG. 6). The sleeve 16 is arranged to be rigidly fixed to the rod, for receiving the end of the spring, for forming a locking means, and for co-operating with a rotational entrainment means; the sleeve 16 comprises an annular chamber 16A provided between the outside surface of a cylinder 16B and an outside wall 16C; the chamber 16A has an end portion 16D and, opposite its end portion, opens in the vicinity of an end 16E of the cylinder which, at its centre, has an opening 16F which is of polygonal section, being for example of square section. On its outside surface, the sleeve comprises at least one locking means which in this embodiment comprises two diametrally oppositely disposed lugs 16G and also, in its end portion 16D, a recess for receiving a buffer member 16H of flexible material.

The cylinder 16B which is hollow receives a terminal portion of the rod 11 which is rigidly fixed to the sleeve by crimpings 18.

The operating handle 15 comprises an outside casing 19 into which is engaged a sleeve member as indicated generally at 20. The sleeve member is a slight force fit in the casing 19 and is clipped thereto as will be described hereinafter, so that the sleeve member and the casing are rigidly fixed together.

In the illustrated embodiment, the sleeve member 20 comprises two semicylindrical half shell portions 20A and 20B comprising a terminal portion referred to as the front terminal portion PA and a terminal portion referred to as the rear terminal portion PP.

As shown in FIG. 3, the two half shell portions 20A and 20B are disposed in side-by-side relationship, being symmetrical on respective sides of a joint plane PJ; one at least thereof comprises a slot intended to co-operate with the locking means provided on the sleeve 16; in the embodiment illustrated, each half shell comprises a slot 20C and 20D which has a longitudinal portion 20E and 20F extending from a front portion region towards the rear portion; in the front portion region, said longitudinal portion is prolonged by a transverse portion 20G and 20H. At their rear ends, the half shells form an end portion 20I which is extended by a tubular projection 20J comprising an outside lip 20K which is intended for clipping of said half shells to the casing 19 by the lip 20K co-operating with a collar portion 19A provided at the end of the casing, as can be clearly seen from FIGS. 1, 7 and 8.

The sleeve member 20 which is thus formed by the half shell portions is associated with the casing 19, the two elements referred to above are assembled for rotational movement and assembly thereof is effected in such a way that the lugs 16G carried by the sleeve 16 are engaged in the corresponding slots.

A spring 35 is fitted within the sleeve member 20; it bears by way of one end against the end portion 16D of the sleeve 16 and by way of its other end against a front face of a washer 40 which itself bears against the end portion 20I formed by the half shell portions.

The handle is completed by an operating button 43 comprising an axial control rod 43A whose section corresponds to the polygonal opening 16F in the sleeve 16; in the illustrated embodiment, the control rod is of square section and is engaged in the above-mentioned opening. The operating button 43 is adapted to cap the corresponding terminal portion of the casing 19 and it is axially associated therewith and with the sleeve member 20 by means of a circular rib 43B which is a force fit in a groove 45 provided for that purpose in the end portion 20I of the sleeve member 20.

The button 43 is therefore coupled to the sleeve 16 by its control rod 43A and it is axially associated with the assembly of the sleeve member 20 and the casing 19, being capable of rotary movement with a range of angular motion which is limited by the possible travel of the lugs 16G in the transverse portions 20G and 20H of the slots 20C and 20D.

In order to ensure that the operating button 43 does not unexpectedly turn about itself during inflation operations, means for blocking it in one of its two positions, as defined by the motion of the lug in the transverse portions of the slots, are formed in the illustrated embodiment (see FIGS. 4 and 5) by at least one stud provided on the inside face of the end portion 20I of the sleeve coming into latching engagement with one of two angularly displaced recesses provided on a corresponding face of the washer 40.

As illustrated, the end portion 20I comprises two diametrally oppositely disposed lugs 50 and 51 adapted to co-operate with two pairs of diametrally oppositely disposed recesses 52 and 53 which are angularly displaced and which are provided on the rear face of the washer 40.

The washer 40 is fixed in respect of rotation to the control rod 43A of the operating button 43 by means of an opening 40A of square section, and, the angular displacement of the pairs of recesses 52 and 53 corresponding to the limit positions of the lugs 16G in the transverse portions 20G and 20H of the slots, it will be seen that in one or other of the angular positions of the operating button, the button can rotate only if it is manually actuated to do so.

As illustrated in FIG. 1, the person using the pump may perform an inflation operation, the spring 35 being unstressed and neutralized because the sleeve 16 is immobilized in the handle 15 by the lugs 16G being engaged into the transverse portions 20G and 20H of the slots 20C and 20D.

There is therefore no possibility of axial sliding movement of the sleeve 16 within the handle 15.

In order to fit the pump to a bicycle frame, the spring 35 must be freed.

For that purpose, the operating button 43 is rotated in the direction indicated by the arrow F1 (see FIG. 2), the effect of which is simultaneously to entrain the washer 40, the sleeve 16 and therefore the lugs 16G in the transverse portions of the slots, until they come into line with the longitudinal portions 20E and 20F of the slots.

The operating button 43 is held stable in such a position by the positional blocking means. In that connection, it will be noted that in the position of the handle shown in FIG. 1, the studs 50 and 51 are engaged with the pair of recesses 52 provided in the washer 40 while in the position of the handle 15 illustrated in FIG. 7, following the rotational movement of the washer 40 by the control button 43, it is the pair of recesses 52 which are engaged with the studs or projections 50 and 51.

The sleeve 16 can slide within the sleeve member 20, causing the spring 35 to be compressed for the purpose of fixing the pump to a bicycle frame, as illustrated in FIG. 8.

In another embodiment as illustrated in FIGS. 9 to 13, the pump body of which part is illustrated is indicated at 110; disposed movably in the pump body is a piston (not shown) which is connected to an end of a rod 111 which is mounted slidably in a screwthreaded plug or closure member 112 which closes off the pump body at the air intake end, the closure member 112 comprising in known fashion a passage 113 for the intake of air into the pump body when the rod and consequently the piston are pulled in the direction indicated by the arrow F2.

The rod 111 in the position shown in FIG. 9 is at the end of an air discharge phase, that is to say, the piston is in the immediate vicinity of the other end of the pump body.

The rod 111 has a terminal portion 111A which projects with respect to the closure member 112, and the terminal portion 111A is provided with an extension forming an end abutment and adapted to receive a retractable abutment disposed at a spacing from the end abutment.

In the illustrated embodiment, the extension comprises a sleeve 117 which is fitted onto the terminal portion to which it is secured for example by a crimping means as indicated at 118.

At a terminal portion, the above-mentioned sleeve 117 has an inwardly directed flange portion 120 which forms the end abutment, and also at the same time a bearing 121 in which a return element 122 which is fixed with respect to the handle 126 is slidable. In the illustrated embodiment, the return element 122 is formed by a tube comprising a head 123 at one end and being adapted at the other end to be fixed by two half ring members 124 towards the free end of the handle 126 which is arranged for that purpose.

Towards its other terminal portion, the sleeve 117 comprises a circular groove 130 into which is fitted the retractable abutment as indicated generally at 115 and formed, in the illustrated embodiment, by an elastically retractable ring having an opening as indicated at 132 in FIGS. 10 and 11; the open retractable ring has two lips 136 and 137 which extend parallel to the general plane of the ring and which, starting from the edges 138 and 139 provided by the opening 132, are of a progressively decreasing height to be joined together substantially at the position of a support projection 140 provided on the inside face of the bore in the ring, in diametral relationship with respect to the centre of the opening. The support projection 140 is co-operable with the bottom of the groove 130 and is thus capable of centering the ring in the groove.

The above-mentioned lips each form a thrust face 141 and 142 which is intended to co-operate with the free end edge 126A of the handle 126 when obviously the retractable abutment 115 is in the active unstressed position.

In addition, on its face opposite to the end abutment 120, the sleeve 117 has a circular recess 143 for receiving a check or buffer member 144 of relatively flexible material.

The sleeve 117 also has an annular chamber 150 formed between a skirt 151 whose outside surface is adapted to co-operate with the inside wall of the handle, to form a guide therefor, and a wall 152. The above-mentioned annular chamber receives a terminal portion of the spring 153, the other terminal portion of which is engaged in an annular space 154 provided for that purpose within the handle 126, towards its free end.

In the illustrated embodiment, when the retractable abutment 115 is in the active unstressed position (see FIGS. 1, 2 and 3), it co-operates by means of its lips 136 and 137 and more particularly the support faces 141 and 142 formed by the lips, with the end edge 126A of the handle 126 while the head 123 of the return element 122 is in contact with the end abutment 120. With the components in the above-indicated position, the rod 111 carrying the piston is connected to the handle for use of the pump and the thrust force applied to the handle 126 (air discharge phase) is transmitted by the co-operation of the edge 126A of the handle with the support faces 141 and 142 provided on the lips 136 and 137 of the retractable abutment, while the pulling force (air intake phase) applied to the handle 126 is transmitted by the co-operation of the head 123 of the return element 122 with the end abutment 120. It will be noted that the pump goes from the air discharge phase to the air intake phase without play by virtue of the retractable abutment 115 being in contact with the handle while the end abutment is in contact with the head 123 of the return element 122.

Throughout the inflation operation, it is observed that the spring 153 which is in an unstressed condition within the handle is neutralized so that it is not subjected to a force.

When the operation of inflating the tire is completed, and the required pressure has been reached, the pump may be removably fixed to a bicycle frame along the seat tube by bearing at the discharge end of the pump against the bottom bracket assembly and the down tube, and at the handle end against the top tube.

The spring 153 must be capable of performing its function because, by virtue of its extension force, it ensures that the pump is fixed on the frame, and that can be done by positioning the retractable abutment 115 in the retracted inoperative position.

Figure 5:
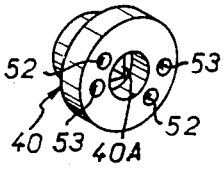

For that purpose, the user only has to apply a pinching force to the lips 136 and 137 in order at least partially to close the opening 132 of the ring so that the lips 136 and 137 can be engaged within the handle 126, by applying a thrust force to the handle. With the retractable abutment 115 in that position, the handle 126 can be slid with respect to the sleeve 117 against the force of the spring 153 until the spring is totally compressed. FIG. 12 shows the retractable abutment 115 in its retracted inoperative position, at the beginning of its engagement within the handle 126, with the spring 153 being slightly compressed. The pump can thus be fixed to a bicycle frame, by compressing the spring to a greater or lesser degree depending on the height of the seat tube. It will be noted that the travel movement C of the handle 126 as illustrated in FIGS. 4 and 5 permits a pump according to the invention to be fixed to a range of frames of different heights at the seat tube.

For a fresh inflation operation, as soon as the pump is removed from the frame, it automatically takes up its position of use, as the spring 153 which expands applies a thrust force to the handle 126 which slides with respect to the sleeve 117 until the head 123 of the return element comes into contact with the end abutment while the retractable abutment 115 is freed and automatically returns to an active position in contact with the edge 126A of the handle.

It will be appreciated that the invention is not limited to the embodiments selected and illustrated which on the contrary may be the subject of modifications without thereby departing from the scope of the invention.

I claim:

1. A portable pump for inflating tires, in particular for a bicycle, comprising a pump body (10) in which a piston is movable, the piston being mounted to the end of a rod (11) which is operable with a reciprocating motion by means of a handle (15, 126), and a spring (35, 53) operatively interposed between the rod and the handle, characterised in that the piston carrying rod comprises at its terminal portion remote from the piston an extension (16, 117) which is capable of sliding movement within the handle (15, 126), and which carries at least one locking means (16G, 115) which is capable either of immobilizing said extension within the handle, with the spring being neutralized, or permitting sliding movement of the extension in the handle (15, 126) against the force of the spring (35), whereby the spring is neutralized during the pumping action and is activated during or for storage of the pump.

2. A portable pump according to claim 1, characterised in that the handle comprises an outside casing (19) adapted to receive a sleeve member (20) having a terminal portion referred to as a front terminal portion (PA) and another terminal portion referred to as a rear terminal portion (PP) and comprising means for clipping to said casing, a slot being provided in said sleeve member (20).

3. A portable pump according to claim 2, characterised in that the sleeve member (20) comprises two cylindrical half shell portions (20A, 20B) of revolution, which are symmetrical on respective sides of a diametral plane, each half shell portion comprising a slot (20E, 20F) with transverse portion (20G, 20H) towards said rear portion (PP).

4. A portable pump according to claim 3, characterised in that in the rear portion (PA) the half shells comprise a projection (20J) having an outside lip (20K) for clipping to an end collar portion (19A) provided for that purpose on the casing (19).

5. A portable pump according to claim 2, characterised in that an operating member (43) comprises an end button which is associated with the sleeve (16) by a control rod (43A) which is coaxial with the handle (15), the end button (43) co-operates with setting means (50 to 53) for causing it to occupy either one of two stable angular positions.

6. A portable pump according to claim 5, characterised in that the setting means comprise a washer (40) which is fixed in respect of rotary movement to the control rod (43A) of the end button (43) on a face of which are provided at least two angularly displaced recesses (52, 53) adapted to co-operate with at least one stud (50, 51) provided on the inside face of an end portion (20I) formed by the sleeve member (20).

7. A portable pump according to claim 6, characterised in that the sleeve (16) comprises an annular chamber (16A) for receiving a terminal portion of the spring (35) while the other terminal portion of the spring bears against the washer (40).

8. A portable pump according to claim 1, characterised in that the extension (16, 117) is formed by a sleeve which is fixed to the end of the piston carrying rod (11, 111).

9. A portable pump according to claim 8, characterised in that the locking means carried by the sleeve (16) comprises at least one lug (16G) displaceable in a slot (20C, 20D) provided in the handle (15), by means of an operating member (43) which is mounted rotatably between two given positions.

10. A portable pump according to claim 9, characterised in that the slot (20C, 20D) has a longitudinal portion (20E, 20F) which is extended by a transverse portion (20G, 20H) disposed in opposite relationship to an end button.

11. A portable pump according to claim 8, characterised in that an operating member (43) comprises an end button which is associated with the sleeve (16) by a control rod (43A) which is coaxial with the handle (15).

12. A portable pump according to claim 11, characterised in that the sleeve (16) is engaged with the end button (43) by way of the control rod (43A) which is polygonal and advantageously square section and on which it is slidable.

13. A portable pump according to claim 11, characterised in that the operating member (43) comprises an end button which is associated with the sleeve (16) by a control rod (43A) which is coaxial with the handle (15), the end button is axially fixed to the sleeve member (20) and an associated casing (19), while being capable of rotary movement with respect to the sleeve member (20) and the casing.

14. A portable pump according to claim 8, characterised in that the sleeve (117) is adapted to carry a retractable abutment (115) and to form at a spacing therefrom a fixed end abutment (120) capable of co-operating with a return element (122) which is fixed with respect to the handle and which is coaxial therewith, while the spring (153) is housed in the handle bearing respectively against the sleeve and against a handle end portion.

15. A portable pump according to claim 14, characterised in that a ring forming the retractable abutment (115) has a radial opening (132) and at least one projecting lip (136, 137) which is parallel to the general plane of the ring and which is adapted to co-operate with a peripheral edge (126A) of the handle.

16. A portable pump according to claim 14, characterised in that the return element (122) is tubular, it is fixed by a terminal portion to the end of the handle (126) and at its other end it comprises a head (123) which is adapted on the one hand to slide within the rod (111) and on the other hand to co-operate with the fixed abutment (120).

17. A portable pump according to claim 14, characterised in that the sleeve (117) comprises an annular chamber (150) with a skirt (151) whose outside surface forms a guide for the handle (126) in the axial movements thereof with respect to the rod (111) and a wall (152).

18. A portable pump according to claim 14, characterised in that the end abutment (120) forms a guide for the return element (122) in the axial movements thereof.

19. A portable pump according to claim 14, characterised in that the retractable abutment (115) comprises a retractable ring which is disposed in a circular groove (130) provided for that purpose in the sleeve (117).

20. A portable pump according to claim 19, characterised in that the retractable ring (115) has two lips (136, 137) whose height decreases from edges (138, 139) formed by an opening (132), said lips extending from said edges into a diametral region in opposite relationship to said opening.

21. A portable pump according to claim 19, characterised in that the retractable ring (115) is provided on the inside face of its bore with a support projection (140) capable of co-operating with the bottom of the groove (130) formed in the sleeve (117), said projection being diametral with respect to a central region of an opening (132).

* * * * *